US006792899B2

(12) United States Patent
Roberts, Jr. et al.

(10) Patent No.: US 6,792,899 B2
(45) Date of Patent: Sep. 21, 2004

(54) METHOD AND APPARATUS FOR ACTIVE CONTROL OF COMBUSTION RATE THROUGH MODULATION OF HEAT TRANSFER FROM THE COMBUSTION CHAMBER WALL

(75) Inventors: Charles E. Roberts, Jr., San Antonio, TX (US); Christopher J. Chadwell, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 7 days.

(21) Appl. No.: 10/272,261

(22) Filed: Oct. 17, 2002

(65) Prior Publication Data

US 2004/0074455 A1 Apr. 22, 2004

(51) Int. Cl.[7] ..... F02F 1/36
(52) U.S. Cl. ..... 123/41.82 R
(58) Field of Search ..... 123/41.21, 41.82 R, 123/78 AA, 48 C, 193.5, 657, 41.1

(56) References Cited

U.S. PATENT DOCUMENTS

| | | | | |
|---|---|---|---|---|
| 2,381,895 A | | 8/1945 | Foster | |
| 3,444,845 A | | 5/1969 | Scheiterlein | |
| 3,970,056 A | | 7/1976 | Morris | |
| 4,286,552 A | | 9/1981 | Tsutsumi | |
| 4,381,736 A | * | 5/1983 | Hirayama | 123/41.1 |
| 4,413,596 A | | 11/1983 | Hirayama | |
| 4,688,523 A | | 8/1987 | Takahashi et al. | |
| 4,890,585 A | | 1/1990 | Hathorn | |
| 5,003,936 A | | 4/1991 | Scherer | |
| 5,065,707 A | | 11/1991 | Elsbett et al. | |
| 5,333,575 A | | 8/1994 | Olmr | |
| 5,341,771 A | | 8/1994 | Riley | |
| 5,934,228 A | | 8/1999 | Wheat | |

* cited by examiner

*Primary Examiner*—Tony M. Argenbright
*Assistant Examiner*—Hyder Ali
(74) *Attorney, Agent, or Firm*—Gunn & Lee, PC

(57) ABSTRACT

The flame propagation rate resulting from a combustion event in the combustion chamber of an internal combustion engine is controlled by modulation of the heat transfer from the combustion flame to the combustion chamber walls. In one embodiment, heat transfer from the combustion flame to the combustion chamber walls is mechanically modulated by a movable member that is inserted into, or withdrawn from, the combustion chamber thereby changing the shape of the combustion chamber and the combustion chamber wall surface area. In another embodiment, heat transfer from the combustion flame to the combustion chamber walls is modulated by cooling the surface of a portion of the combustion chamber wall that is in close proximity to the area of the combustion chamber where flame speed control is desired.

6 Claims, 1 Drawing Sheet

METHOD AND APPARATUS FOR ACTIVE CONTROL OF COMBUSTION RATE THROUGH MODULATION OF HEAT TRANSFER FROM THE COMBUSTION CHAMBER WALL

GOVERNMENT LICENSE RIGHTS

The U.S. Government has a paid up license in this invention in the right in certain circumstances to require the patent owner to license others on reasonable terms as provided for by the terms of Contract No. DE-AT26-98FT40398, awarded by the U.S. Department of Energy.

BACKGROUND OF THE INVENTION

1. Technical Field

This invention relates generally to an apparatus and method for controlling heat losses in the combustion chamber of an internal combustion engine, and more particularly to such an apparatus and method for the active control of the combustion rate in an internal combustion engine.

2. Background Art

The operating setpoints of modern reciprocating engines are best described as a compromise between settings that allow highest engine efficiency, settings that reduce regulated emissions and settings that reduce the tendency for the engine to knock. The compromised setpoints define engine performance/emissions tradeoffs that are far from optimal solutions for any one of the individual performance or emissions targets. Therefore, the design of an engine's combustion chamber is typically directed at satisfying a range of operating conditions most common to the end-user. However, because an engine must often operate for short periods at off-design conditions, compromises in combustion chamber design must be made to ensure that emissions regulations are met, or that engine damage does not occur.

Several approaches have been proposed for static, or steady state, control of heat loss through the walls of a combustion chamber when an engine is operating at off-design conditions to reduce possible damage to the engine and minimize any compromise of emissions. For example, U.S. Pat. No. 4,413,596, granted Nov. 8, 1983, to Tsutoma Hirayama for an ENGINE COOLING SYSTEM WITH OPTIONALLY COMMUNICABLE HEAD COOLING CIRCUIT AND BLOCK COOLING CIRCUIT, AND METHOD OF OPERATING THE SAME, describes the use of separate block and cylinder head cooling systems with active control of each system. In the Hirayama system, engine knock is controlled by cooling the cylinder head. More recently, U.S. Pat. No. 5,934,228, granted Aug. 10, 1999, to Fred Wheat for an ADJUSTABLE COMBUSTION CHAMBER INTERNAL COMBUSTION ENGINE describes a variable compression ratio device and modulates the compression ratio for optimized engine performance. The Wheat patent further describes the use of reciprocating engine sleeves to optimize fuel-air delivery timing in a two-stroke engine.

A combustion chamber design and method for steady state combustion control is described in co-pending U.S. application Ser. No. 09/974,210, filed Oct. 10, 2001, by Charles Edward Roberts, Jr., a co-inventor of the present invention, for a MULTI-ZONE COMBUSTION CHAMBER FOR COMBUSTION RATE SHAPING AND EMISSIONS CONTROL IN PREMIXED-CHARGE COMBUSTION ENGINES. The co-pending application describes a combustion chamber design that can be effected to reduce flame speed, i.e, flame front propagation rate, for a portion of the combustion event, thus allowing some design control of peak cylinder temperatures or pressures to reduce knock occurrence and emissions while maintaining high engine efficiency.

However, it has heretofore not been possible to actively control heat losses from the flame produced by the combustion event. The present invention is directed to resolution of that problem as well as the problems associated with other prior control systems. It is desirable to have a system for actively controlling local flame speed within the combustion chamber of an internal combustion engine, and thereby control heat losses from the flame to the walls of the combustion chamber. Control of local flame speed and attendant heat losses to the cylinder walls permit reduction in $NO_x$ emissions, improved $NO_x$ control and higher engine efficiency without compromising emissions control. It is also desirable to have a means for controlling the temperature of the combustion chamber wall near the flame to modulate local heat transfer rate within the combustion chamber. Modulation of the local flame speed allows control of heat losses and permits combustion control for beneficial reductions in $NO_x$ emissions, improved $NO_x$ control and improved engine efficiency at given $NO_x$ emissions levels.

SUMMARY OF THE INVENTION

In accordance with one aspect of the present invention, an apparatus for the active control of the combustion rate of an air and fuel mixture in a combustion chamber of an internal combustion engine includes a movable member that is extendable through a predefined wall of the combustion chamber whereby the wall area of the combustion chamber is controllably modified during operation of the engine. The apparatus further includes a means for moving the movable member into and from the combustion chamber and a control means for controlling the movement of the movable member into and from the combustion chamber.

In accordance with another aspect of the present invention, an apparatus for the active control of the combustion rate of an air and fuel mixture in a combustion chamber of an internal combustion engine includes a stationary flame speed control member having an external surface extending into the combustion chamber and defining at least a portion of the wall of the combustion chamber adjacent to a portion of the combustion chamber where control of the flame speed of a combustion event in the combustion chamber is desired. The apparatus further includes a means for modulating the temperature of the external surface of the flame speed control member and a control means for controlling the means for modulating the temperature of the external surface of the flame speed control member.

In accordance with yet another aspect of the present invention, a method for actively controlling the combustion rate of an air and fuel mixture in a combustion chamber of an internal combustion engine includes sensing at least one engine operating parameter of the engine and controllably extending a movable member into and retracting the member from the combustion chamber in response to a sensed value of the engine operating parameter.

In accordance with an additional aspect of the present invention, a method for actively controlling the combustion rate of an air and fuel mixture in a combustion chamber of an internal combustion engine having a flame control member with an external surface extending inwardly into the combustion chamber includes sensing at least one engine operating parameter of the engine and controllably modulating the temperature of the external surface of the flame control member that extends inwardly into the combustion chamber.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF THE INVENTION

The present invention is directed to knock control and emissions reduction without loss of engine efficiency when operating an internal combustion engine at off-design conditions by actively modulating the heat transfer from the combustion flame to the combustion chamber walls. The flame propagation rate within the combustion chamber can be regulated by the amount of the energy lost from the flame during the combustion process. Active control of the heat losses from the flame allows active control of the flame propagation rate within the combustion chamber. Actively controlled combustion rates allow on-the-fly optimization of operating conditions that reduce $NO_x$ emissions while providing the highest engine efficiency without the occurrence of knock.

The dynamic control of flame propagation within the combustion chamber through active modulation of heat losses from the flame to the cylinder wall is demonstrated by Newton's law of cooling, which represents convective heat transfer from a gas to a solid wall;

$$\dot{Q}=hA_w(T_g-T_w)$$

where h is the convective heat transfer coefficient (the combined function of fluid mechanical conditions in the gas, gas properties, and wall effects on both of the previous, $A_w$ is the area of the wall through which heat transfer is occurring. $T_g$ and $T_w$ are the gas and wall temperatures, respectively. As heat transfer from the gas to the wall is increased, local gas, and flame, temperatures will decrease. It is well known that flame speed is an exponential function of unburned gas temperature. Therefore, the flame propagation rate near the wall of the combustion chamber will decrease as cooling rates $\dot{Q}$ near the wall increase.

Figure 1:
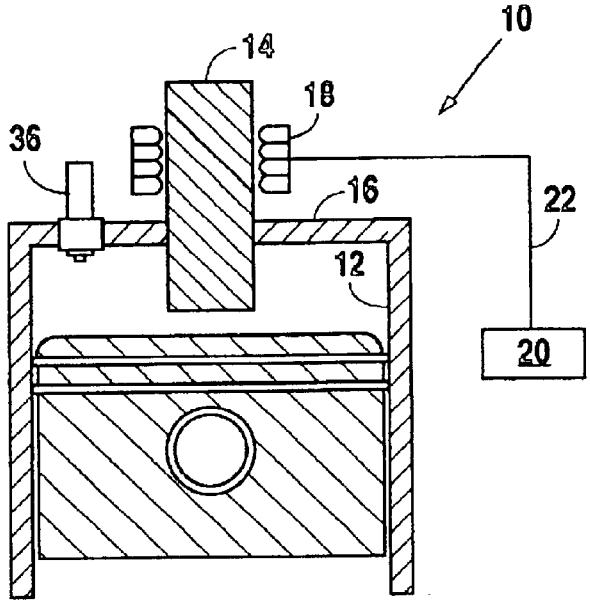
FIG. 1 is a schematic illustration of an apparatus for mechanically modulating the shape of the combustion chamber of an internal combustion engine in accordance with the present invention.

In a preferred embodiment of the present invention, heat transfer from a combustion flame to the surrounding cylinder wall is controlled by modulation of the shape of the combustion chamber local to the flame, as schematically illustrated in FIG. 1. The technique of controlling effective wall area should be understood to mean that the effective wall area $T_w$ local to the flame is modulated so as to control heat transfer losses from the flame to the wall. Furthermore, modifying the shape of the combustion chamber alters the heat transfer rate and affects in-cylinder fluid motion, thus contributing to actively controlled modulation of the heat transfer coefficient h.

With specific reference to FIG. 1, an apparatus 10 for the active control of the combustion rate of an air and fuel mixture in a combustion chamber 12 includes a movable member 14 that extends through a predefined wall, such as the head portion 16 of the combustion chamber 12, whereby the wall area of the combustion chamber 12 is controllably modified during operation of the engine. In the preferred embodiment, the movable member 14 has a cylindrical shape that extends through an opening in the head portion 16 of the combustion chamber 12. Typically, one or more devices, such as a spark plug, glow plug or fuel injector, represented generically by the reference number 36 also extends through the head portion 16 of the combustion chamber 12. The movement into and from the combustion chamber is affected by a means for controllably moving the movable member into and from the combustion chamber, such as a linear actuator or a solenoid actuator 18, as represented in FIG. 1. An electronic control unit (ECU) 20, such as a conventional programmable engine control unit, senses at least one operating parameter of the engine and provides a control signal 22 to the solenoid actuator 18 for movement of the movable member 14. The sensed engine operating parameters include exhaust gas temperature, air/fuel ratio of the charge mixture, engine timing, fuel introduction or injection timing, engine speed, engine load, and/or one or more other sensed or preset parameters indicative of engine operation. In this embodiment, the apparatus 10 mechanically moves the member 14 thereby changing the effective wall area $A_w$, and thus heat transfer loss from the flame.

A method for actively controlling the combustion rate of an air and fuel mixture in the combustion chamber 12, using the above-described apparatus 28, includes sensing at least one engine operating parameter of the engine and controllably extending the movable member 14 into and retracting the movable member 14 from the combustion chamber 12 in response to the value of the sensed operating parameter of the engine.

Figure 2:
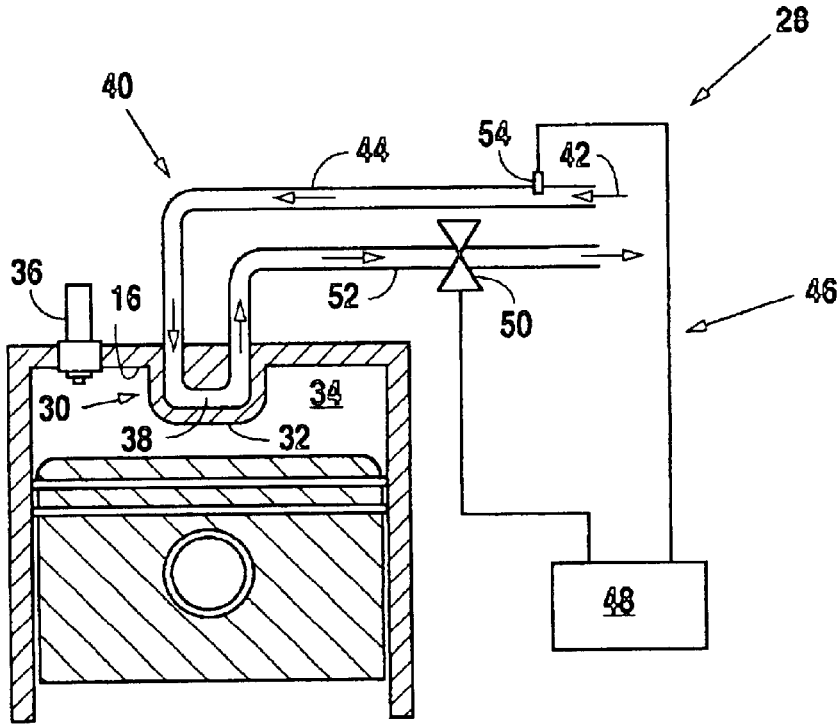
FIG. 2 is a schematic illustration of an apparatus for thermally modulating the surface temperature of a portion of the combustion chamber wall in accordance with the present invention.

In another embodiment of the present invention, schematically illustrated in FIG. 2, an apparatus 28 is provided for controlling the local wall temperature $T_w$ so that the local flame speed in a combustion chamber 34 is modulated. In this embodiment, control of the local wall temperature is provided by thermal modulation, or control, of the wall temperature $T_w$. More specifically, a stationary flame speed control member 30 has an external surface 32 that protrudes, i.e., extends inwardly, into the combustion chamber 34 and defines at least a portion of the combustion chamber adjacent an area where control of the flame speed of a combustion event in the combustion chamber 34 is desired. Importantly, the stationary flame speed control member 30 has a subsurface passageway 38 that is in fluid communication with a means 40 for modulating the temperature of the external surface 32 of the flame control member 30.

The means 40 for modulating the temperature of the external surface 32 of the flame control member 30 includes a source of fluid represented by the directional flow arrow 42, e.g., engine coolant, engine cooling oil or other fluid typically having a temperature less than that of the external surface 32. The means 40 for modulating the temperature of the external surface 32 of the flame speed control member 30 also includes a conduit 44 that provides fluid communication between the source of fluid 42 and the subsurface passageway 38 disposed in the flame speed control member 30.

The apparatus 28 also includes a control means 46 for controlling the means 40 that modulates the temperature of the external surface 32 of the stationary flame, speed control member 30. The control means 46 includes a conventional programmable electronic control unit 48 and at least one sensor, not shown, for sensing an operating parameter of the internal combustion engine, such as exhaust gas temperature, air/fuel ratio of tie charge mixture, engine timing, fuel introduction or injection timing, engine speed and engine load, that are in electrical communication with the electronic control unit 48. The control means 46 also includes at least one flow control valve 50 disposed in a return flow conduit 52 that provides a controlled return flow rate of the fluid 42 from the subsurface passageway 38. The control valve 50 receives command signals from the electronic control unit 46, based upon the sensed value of the above described engine operating parameters. The control valve 50 regulates the flow of cooling fluid 42 through the conduit 44, so that the combustion chamber wall temperature $T_w$ is controlled to desired setpoints for optimal combustion flame speed control. If desired, for closed loop control purposes, a temperature sensor 54 may be positioned in the supply conduit 44 for measuring the temperature of the fluid 42 directed through the subsurface passageway 38 of the flame speed control member 30.

Active control of the combustion rate of an air and fuel mixture in the combustion chamber 34, using the above described alternate apparatus 28 embodiment, includes controllably modulating the temperature of the external surface 32 of the flame speed control member 30 in response to sensing at least one operating parameter of the engine. If desired, fluids other than engine coolant or engine cooling oil, such as other water sources and mixtures of synthetic coolants and water, can be advantageously used to control the temperature,of the external surface 32 of the flame speed control member 30, so that the temperature $T_w$ of the combustion chamber wall 36 is controlled to desired setpoints for optimal combustion flame speed control.

Although the present invention is described in terms of preferred illustrative embodiments, those skilled in the art will recognize that the above-described apparatus and method are illustrative of possible arrangements for controlling the local combustion chamber wall temperature. For example, alternate heating/cooling devices that could affect the temperature $T_w$ of the target wall area include electrical resistance heaters, forced-air fans, silicon-based or conventional thermoelectric devices, miniaturized refrigeration devices, chemically-based refrigeration or heating devices, and Ranque-Hilsch vortex tube devices. Such alternate devices that thermally modulate the temperature of local combustion chamber wall surfaces to actively regulate heat loss for flame control, in accordance with the method embodying the present invention, are intended to fall within the scope of the following claims.

Other aspects, features, and advantages of the present invention may be obtained from a study of this disclosure and the drawings, along with the appended claims.

What we claim is:

1. An apparatus for the active control of the combustion rate of an air and fuel mixture in a combustion chamber of an internal combustion engine, including:

a stationary flame speed control member having an external surface extending into the combustion chamber and defining at least a portion of the wall of the combustion chamber adjacent to a portion of the combustion chamber where control of the flame speed of a combustion event in the combustion chamber is desired;

a means for modulating the temperature of the external surface of said flame speed control member; and a control means for controlling said means for modulating the temperature of the external surface of said flame speed control member in response to sensing at least one operating parameter of the internal combustion engine;

wherein the external surface of said flame speed control member extending into the combustion chamber is a protuberant surface having a surface passageway in fluid communication with said means for controllably modulating the temperature of the external surface of said flame speed control member.

2. An apparatus, as set forth in claim 1, wherein said means for modulating the temperature of the external surface of said stationary flame speed control member includes a source of fluid having a temperature less than the temperature of the external surface of said flame speed control member and at least one conduit providing fluid communication between said source of fluid and said subsurface passageway.

3. An apparatus, as set forth in claim 2, wherein said control means for controlling the means for modulating the temperature of the external surface of said stationary flame speed control member includes an electronic control member, at least one sensor for sensing an operating parameter of the internal combustion engine and in electrical communication with said electronic control member, and a least one fluid flow control valve in electrical communication with said electronic control member and disposed in said conduit providing fluid communication between said source of fluid and said subsurface passageway.

4. An apparatus, as set forth in claim 2, wherein said source of fluid comprises water and mixtures thereof provided by the cooling system of the internal combustion engine.

5. A method for actively controlling the combustion rate of an air and fuel mixture in a combustion chamber of an internal combustion engine having a stationary flame speed control member with an external surface extending into the combustion chamber and defining at least a portion of a wall of the combustion chamber adjacent to a portion of the combustion chamber where control of the flame speed of a combustion event in the combustion chamber is desired, including:

sensing at least one engine operating parameter of the internal combustion engine; and controllably modulating the temperature of the external surface of said flame speed control member in response said sensing at least one operating parameter of the internal combustion engine;

wherein said flame speed control member has a protuberant surface with a surface passageway in fluid communication with a source of fluid having a temperature less than the temperature of the external surface of said flame speed control member and said method includes controllably directing a flow of said fluid through the subsurface passageway.

6. The method, as set forth in claim 5, wherein controllably directing a flow of said fluid through the subsurface passageway includes controllably directing a flow of water and mixtures thereof provided by the cooling system of the internal combustion engine though the subsurface passageway.

* * * * *